US009024711B2

(12) United States Patent
Rubbo

(10) Patent No.: US 9,024,711 B2
(45) Date of Patent: May 5, 2015

(54) THERMAL-MAGNETIC TRIP DEVICE FOR TRIPPING A MULTIPHASE CIRCUIT BREAKER

(71) Applicant: Schneider Electric Industries SAS, Rueil Malmaison (FR)

(72) Inventor: Claude Rubbo, Sassenage (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 27 days.

(21) Appl. No.: 14/081,304

(22) Filed: Nov. 15, 2013

(65) Prior Publication Data

US 2014/0139302 A1 May 22, 2014

(30) Foreign Application Priority Data

Nov. 19, 2012 (FR) ..... 12 03098

(51) Int. Cl.
*H01H 73/48* (2006.01)
*H01H 71/04* (2006.01)
*H01H 71/40* (2006.01)

(52) U.S. Cl.
CPC ..... *H01H 71/04* (2013.01); *H01H 71/40* (2013.01); *H01H 2071/042* (2013.01)

(58) Field of Classification Search
CPC ..... H01H 71/40
USPC ..... 335/23
See application file for complete search history.

(56) References Cited

U.S. PATENT DOCUMENTS

| | | | | |
|---|---|---|---|---|
| 3,258,560 | A * | 6/1966 | Jencks et al. | 335/36 |
| 5,121,092 | A * | 6/1992 | Castonguay et al. | 335/172 |
| 5,281,776 | A | 1/1994 | Morel et al. | |
| 5,317,471 | A | 5/1994 | Izoard et al. | |
| 5,831,499 | A | 11/1998 | Batteux et al. | |
| 6,137,386 | A * | 10/2000 | Mueller | 335/202 |
| 6,239,677 | B1 | 5/2001 | Ramakrishnan et al. | |
| 7,323,956 | B1 * | 1/2008 | Puskar et al. | 335/6 |

FOREIGN PATENT DOCUMENTS

| | | | |
|---|---|---|---|
| DE | 10 2008 008 032 | A1 | 8/2009 |
| EP | 0 542 636 | A1 | 5/1993 |
| EP | 0 542 641 | A1 | 5/1993 |
| EP | 0 848 404 | A1 | 6/1998 |
| EP | 0 954 002 | A2 | 11/1999 |

OTHER PUBLICATIONS

French Preliminary Search Report issued Aug. 1, 2013, in French Application No. 12 03098 filed Nov. 19, 2012 (with English Translation of Categories of Cited Documents), 3 pages.

* cited by examiner

*Primary Examiner* — Alexander Talpalatski
(74) *Attorney, Agent, or Firm* — Oblon, McClelland, Maier & Neustadt, L.L.P.

(57) ABSTRACT

A trip device comprises a first transmission bar pivoting around the same pivoting axis as a ratchet by any one of several thermal actuators. The first transmission bar drives the ratchet from a latched position to a released position, and makes a first indicator change state. A second transmission bar can be pivoted around the same pivoting axis as the ratchet by any one of several magnetic actuators. This second transmission bar drives the ratchet from its latched position to its released position, and makes a second indicator change state.

8 Claims, 6 Drawing Sheets

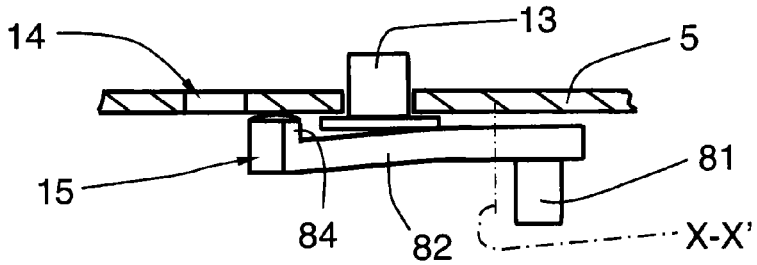
Fig. 12
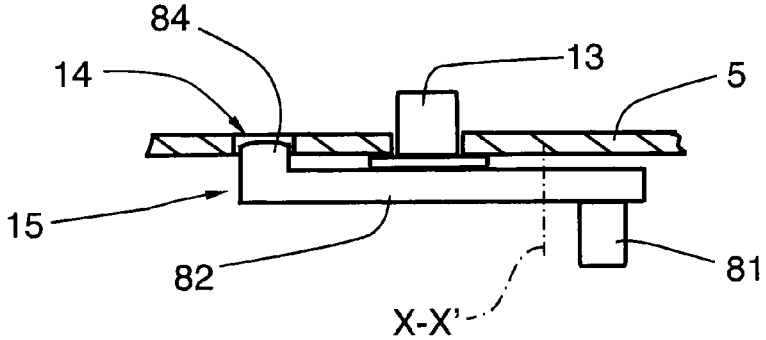
Fig. 13
Fig. 14
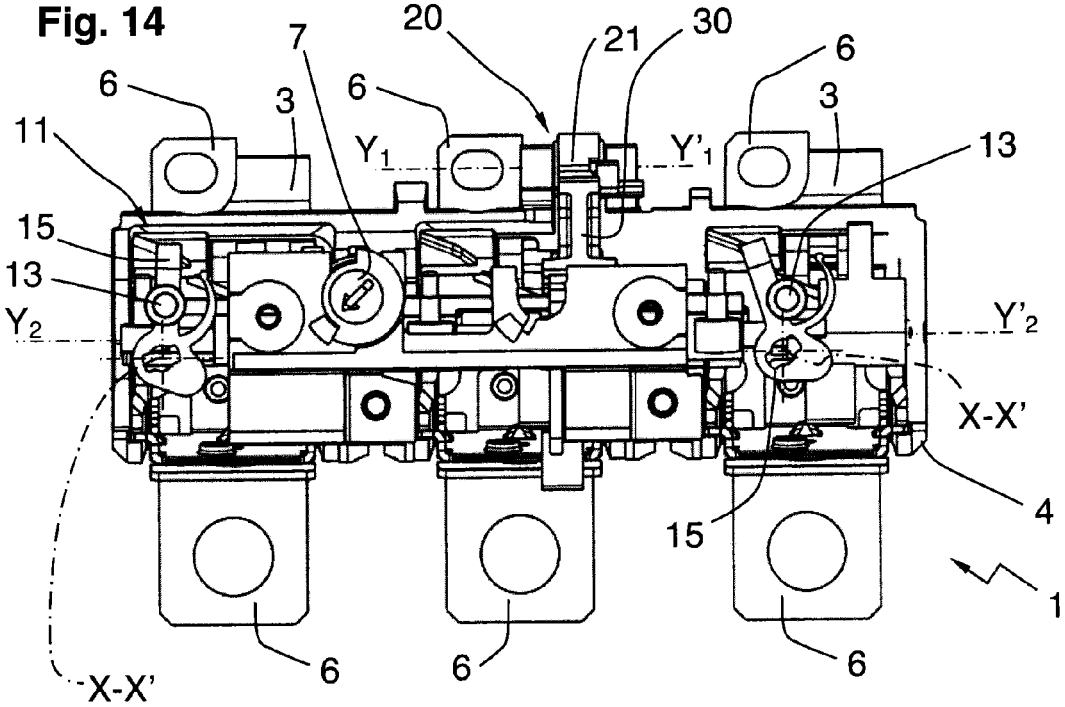

THERMAL-MAGNETIC TRIP DEVICE FOR TRIPPING A MULTIPHASE CIRCUIT BREAKER

BACKGROUND OF THE INVENTION

The invention relates to a thermal-magnetic trip device for monitoring several phase currents flowing in a multiphase circuit breaker and for tripping this multiphase circuit breaker in case of an anomaly affecting at least one of the phase currents.

STATE OF THE ART

A circuit breaker can be used to simultaneously procure two protections, i.e. protection against persistent overcurrents, also called current overloads, and protection against very high currents resulting from a short-circuit. Tripping of the circuit breaker, i.e. opening of its contacts, can be commanded by a thermal-magnetic trip device, which recognizes both current overloads and short-circuits.

In European Patent application EP 0,848,404, a part of a thermal-magnetic trip device is described that has numerous advantages, for example the advantage of being able to be directly associated with any one of several multiphase circuit breakers of a certain type so as to be able to command tripping of the latter. Another part of this thermal-magnetic circuit breaker is presented in European Patent application EP 0,542,641. The thermal-magnetic trip device disclosed in the above-mentioned Patent applications EP 0,848,404 and EP 0,542,641 does not enable the cause of tripping to be known, whatever this cause may be.

After tripping caused by a short-circuit, the origin of this short-circuit has to be sought to be found before the circuit breaker is closed again. Tripping consecutive to a current overload does not generally require the same inspection measures as tripping caused by a short-circuit. It is therefore advantageous, after tripping of a circuit breaker has taken place, to be able to know whether the cause of this tripping was a current overload or a short-circuit.

European Patent application EP 0,954,002 proposes a circuit breaker that is able to mechanically indicate whether the cause of tripping was a current overload or a short-circuit. Another example of a circuit breaker being able to mechanically indicate the cause of tripping between a current overload and a short-circuit is to be found in U.S. Pat. No. 6,239,677. In the circuit breaker presented in this U.S. Pat. No. 6,239,677 as in the one described in above-mentioned European Patent application EP 0,954,002, the mechanism to trip the circuit breaker in the event of a short-circuit or a current overload is complex and comprises numerous constituent parts. Furthermore, this mechanism is bulky and is not suitable for or easily adaptable to certain circuit breakers.

SUMMARY OF THE INVENTION

The object of the invention is at least to enable the thermal-magnetic trip device for monitoring several phase currents and for tripping a circuit breaker to mechanically indicate whether the cause of tripping was a current overload or a short-circuit, while at the same time being less complex.

According to the invention, this object is achieved by means of a thermal-magnetic trip device for monitoring several phase currents flowing in a multi-phase circuit breaker and for performing tripping of this multiphase circuit breaker in case of an anomaly affecting at least one of the phase currents. This thermal-magnetic trip device comprises:

several phases, several thermal actuators each of which is designed to react to a current overload in one of the phases by generating a mechanical tripping command, several magnetic actuators each of which is designed to react to a short-circuit in one of the phases by generating a mechanical tripping command, an intermediate transmission device configured to be able to receive any one of the mechanical tripping commands and comprising a ratchet flexibly biased in a first direction to a latched position and arranged in such a way that receipt of a tripping command by the transmission device makes this ratchet move from its latched position, in which the ratchet can secure a tripping part in a neutral state by latching, to a released position in which the tripping part is disengaged from the ratchet, a support shaft on which the ratchet is fitted so as to be able to swivel around a pivoting axis between its latched and released positions, a first indicator designed to indicate tripping caused by a current overload, and a second indicator designed to indicate tripping caused by a short-circuit.

The intermediate transmission device comprises:

a first transmission bar fitted on said support shaft so as to be able to be pivoted around the same pivoting axis as the ratchet, in a second direction opposite to the first direction, by any one of the thermal actuators, with a movement in the course of which this first transmission bar both drives the ratchet from its latched position to its released position and makes the first indicator change state, and a second transmission bar fitted on said support shaft so as to be able to be pivoted around the same pivoting axis as the ratchet, in the second direction, by any one of the magnetic actuators, with a movement in the course of which this second transmission bar both drives the ratchet from its latched position to its released position and makes the second indicator change state.

The first and second transmission bars are disconnected from one another in pivoting around the pivoting axis.

According to a preferred embodiment, the trip device comprises a first flexible member biasing the first transmission bar to a rest position, a second flexible member biasing the second transmission bar to a rest position, and a third flexible member biasing the ratchet away from its released position to its latched position. The first transmission bar comprises several first bearings fitted on the support shaft, and at least a first tie bar rigidly associating the first bearings to one another, the second transmission bar comprising several second bearings fitted on the support shaft, and at least a second tie bar rigidly associating the second bearings to one another, the first and second bearings being offset from one another along said pivoting axis.

According to one feature of the invention, the first transmission bar comprises first arms arranged in such a way that, by acting on one of these arms, each thermal actuator can make the first transmission bar swivel in the second direction.

In similar manner, the second transmission bar comprises second arms arranged in such a way that, by acting on one of these arms, each magnetic actuator can make the second transmission bar swivel in the second direction.

At least one of the first and second indicators comprises:

a window arranged through an enclosure of the thermal-magnetic trip device, and an indicating part movable between a first state in which there is no portion of this indicating part located at the level of the window, and a second state in which the indicating part is at least partially visible from the outside through the window.

BRIEF DESCRIPTION OF THE DRAWINGS

Other advantages and features will become more clearly apparent from the following description of a particular embodiment of the invention given for non-restrictive example purposes only and represented in the appended drawings, in which:

FIG. 12 is a simplified partial view, in cross-section along the plane XII of FIG. 1, and represents the indicating part of FIG. 9, as well as other constituent parts of an indicator forming the trip device of FIG. 1, FIG. 13 is a similar view to FIG. 12 and represents the same constituent parts as this FIG. 12 after a change of state of the indicator comprising these constituent parts, FIG. 14 is a front view of the trip device of FIG. 1 without its front cover and shows which are the respective positions of the two indicating parts after a tripping command generated by the trip device due to a current overload in a phase.

DESCRIPTION OF A PREFERRED EMBODIMENT OF THE INVENTION

Figure 1:
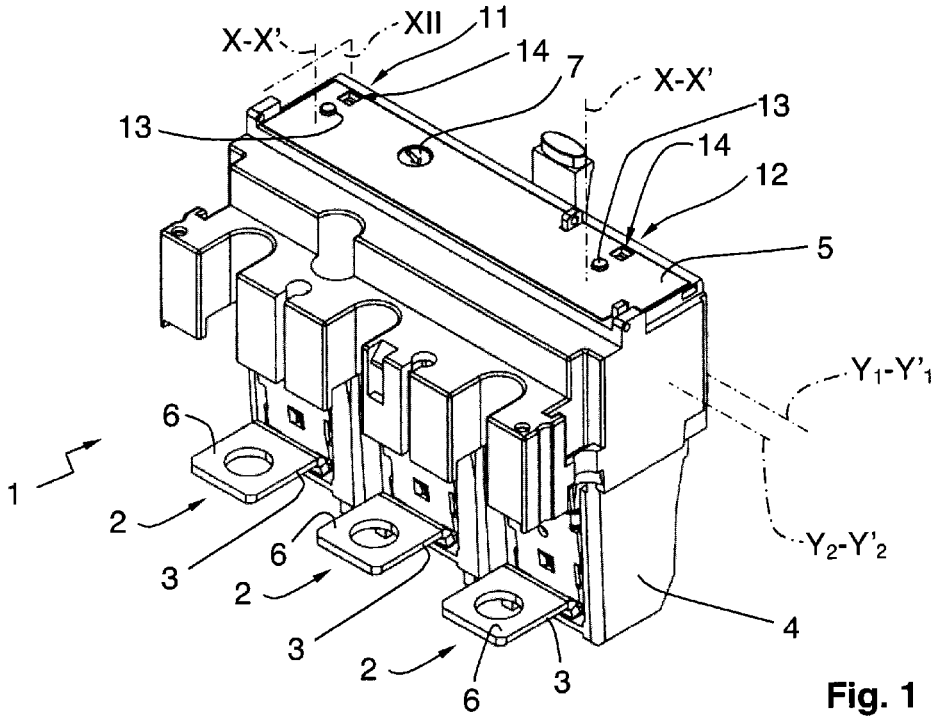
FIG. 1 is a perspective view of a thermal-magnetic trip device according to the invention designed to be associated with a multi-phase circuit breaker so as to be able to command tripping of the latter.

In FIG. 1, a multiphase thermal-magnetic trip device 1 according to the invention is designed to be associated with a multiphase circuit breaker that is not represented, such as the one described in European Patent application EP 0,542,636. Once installed, the function of trip device 1 is to monitor the phase currents flowing in the phases of the multiphase circuit breaker and to trip this circuit breaker in the case of a current overload in one of the phases or in case of a short-circuit affecting at least one of the phases.

In the example represented, trip device 1 has three phases 2, each of which comprises a conductor 3 through which one of the phase currents to be monitored is designed to flow. Trip device 1 comprises an insulating enclosure which comprises an assembly case 4 and a front cover 5 fixed to one another. Each conductor 3 has the form of a tab bent several times, each end of which forms an electric connection terminal 6 extending outside assembly case 4.

A pivoting adjustment means 7 is accessible via a hole arranged in front cover 5.

Trip device 1 comprises two identical indicators 11 and 12 which have the function of indicating together whether a tripping command that was sent was due to a current overload or to a short-circuit. More precisely, when a tripping command was generated by circuit breaker 1 due to a current overload flowing in a conductor 3, this is indicated by indicator 11. Indicator 12 serves the purpose of indicating each tripping command performed that was generated by circuit breaker 1 due to a short-circuit. Each of indicators 11 and 12 comprises a push-button 13 and a window 14 passing through front cover 5 from side to side.

Figure 2:
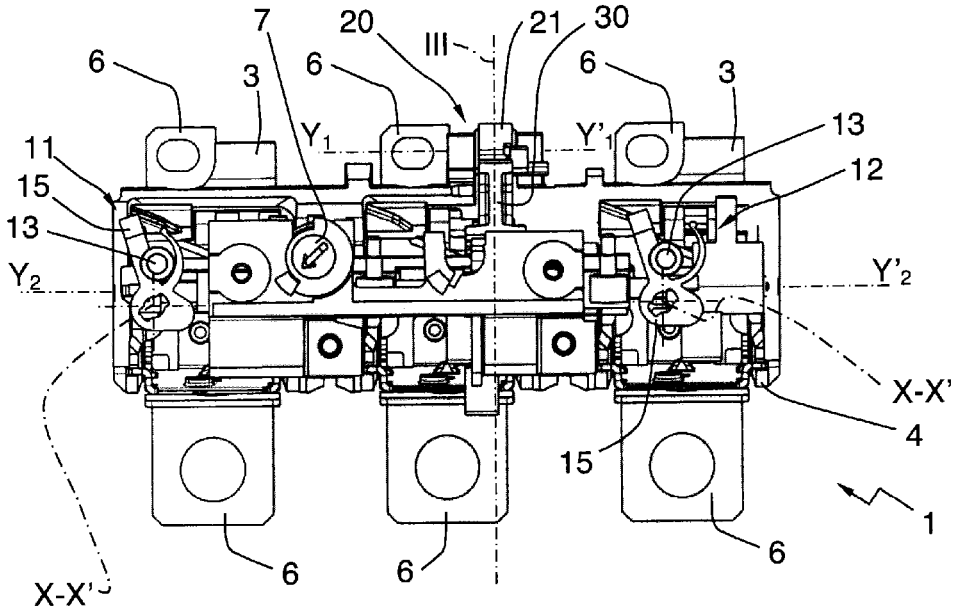
FIG. 2 is a front view representing the same trip device as FIG. 1, without its front cover.

As can be seen in FIG. 2, each of indicators 11 and 12 further comprises indicating parts 15 fitted behind a front panel of front cover 5 so as to be able to swivel around a pivoting axis X-X' substantially perpendicular to this front panel. Each push-button 13 passes through front cover 5, at the level of the finger of one of indicating parts 15. It can exert a transverse thrust force on this finger, after it has itself been pushed manually from the outside.

Figure 3:
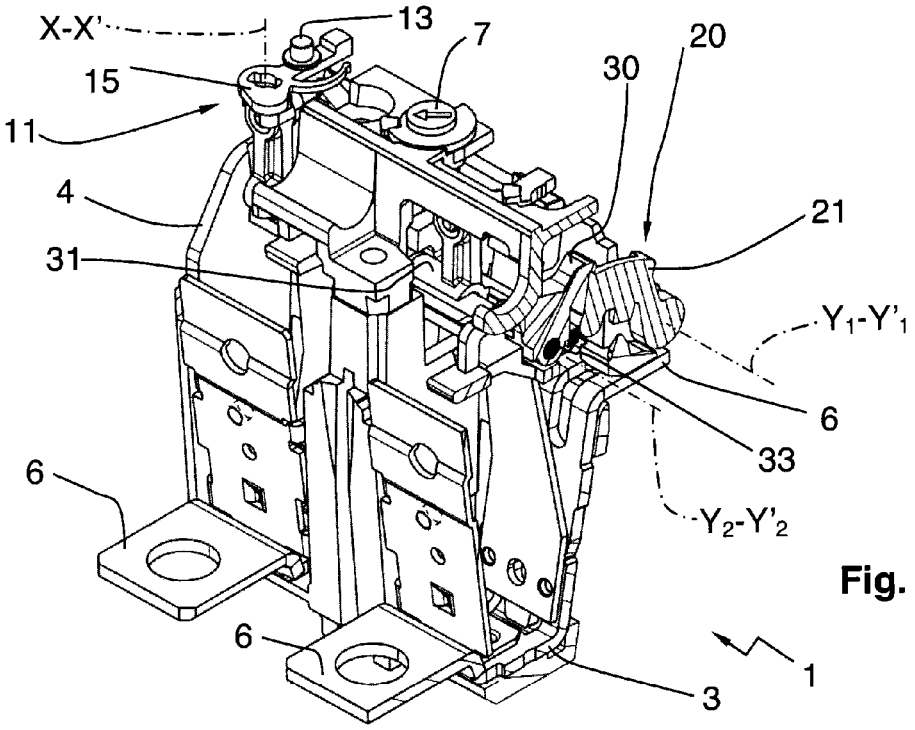
FIG. 3 is a perspective view in cross-section along the plane III of FIG. 2, and represents the same trip device as FIG. 1, without its front cover.

Trip device 1 comprises an energy storage mechanism 20 known as such, a striker 21 of which is visible in FIG. 3. This striker 21 is a tripping part able to be pivoted around a pivoting axis $Y_1$-$Y'_1$, between a neutral position and an active position to which striker 1 is flexibly biased by a spring that is not visible in the figures. In FIG. 3, energy storage mechanism 20 is loaded, in so far as striker 21 is held in its neutral position on account of its being latched to a ratchet 30 itself being in a latched position. Actuation of ratchet 30 to a released position leads to disengagement of striker 21, which results in the flexible bias exerted on this striker 21 being released, the striker then being driven in a tripping movement until it acquires sufficient inertia to produce a percussion that is able to trip the circuit breaker.

Figure 4:
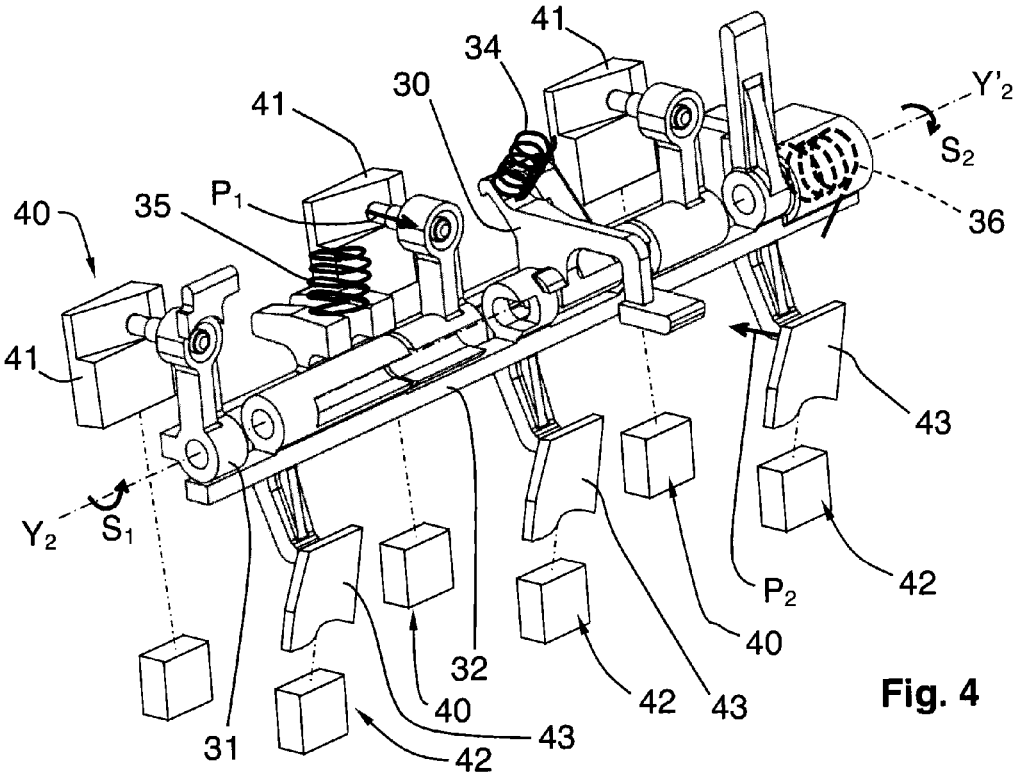
FIG. 4 is a partially schematic perspective view representing only certain internal constituent parts of the trip device of FIG. 1, in particular a first transmission bar, a second transmission bar and a ratchet of an intermediate transmission device.

Reference is now made to FIG. 4. Ratchet 30 forms part of an intermediate transmission device which comprises two other pivoting parts, i.e. two transmission bars 31 and 32. Ratchet 30 and transmission bars 31 and 32 are fitted on the same common support shaft 33 so as to be able to all swivel around the same pivoting axis $Y_2$-$Y'_2$. Not represented in FIG. 4 for the sake of clarity but visible in FIG. 3, support shaft 33 is secured to case 4 via its two opposite ends. Transmission bars 31 and 32 are disengaged from one another by pivoting around their common pivoting axis $Y_2$-$Y'_2$.

A compression spring 34 forms a flexible biasing means of ratchet 30 to its latched position, around pivoting axis $Y_2$-$Y'_2$, in a direction $S_1$. The reference $S_2$ designates the opposite direction to the direction $S_1$.

A compression spring 35 forms a flexible bias means of transmission bar 31 in the direction $S_1$, around pivoting axis $Y_2$-$Y'_2$, to a rest position. When ratchet 30 is in its latched position and transmission bar 31 is in its rest position, a clearance exists through which transmission bar 31 has to be pivoted in the direction $S_2$ before being able to drive ratchet 30 with it in the same direction $S_2$.

A torsion spring 36 forms a flexible biasing means of transmission bar 32 in the direction $S_1$, around pivoting axis $Y_2$-$Y'_2$, to a rest position. When ratchet 30 is in its latched position and transmission bar 32 is in its rest position, a clearance exists through which transmission bar 32 has to be pivoted in the direction $S_2$ before being able to drive ratchet 30 with it in the same direction $S_2$.

For the sake of clarity, bias springs 34, 35 and 36 are only represented in FIG. 4.

In trip device 1, a thermal actuator 40 with a bimetal is provided for each phase. Known as such, thermal actuators 40 are represented schematically in FIG. 4. Each of them has the constitution and operation described in the above-mentioned European Patent application EP 0,542,641. Each thermal actuator 40 is configured to generate a mechanical tripping command in reaction to a current overload in the corresponding phase. This mechanical tripping command presents the form of a thrust force exerted by a head 41 of thermal actuator 40 on transmission bar 31 and which acts against spring 35, in the direction $S_2$ around axis $Y_2$-$Y'_2$. The arrow $P_1$ symbolizes an example of such a thrust exerted by a thermal actuator 40.

In trip device 1, a magnetic actuator 42 is provided for each phase. Known as such, magnetic actuators 42 are represented schematically in FIG. 4. Each of them can have the constitution and operation described in the above-mentioned European Patent application EP 0,848,404. Each thermal actuator 42 is configured to generate a mechanical tripping command in reaction to a short-circuit concerning the corresponding phase. This mechanical tripping command presents the form of a thrust exerted by a movable flap 43 of thermal actuator 42 on transmission bar 32 and which acts against spring 36, in the direction $S_2$ around axis $Y_2$-$Y'_2$. The arrow $P_2$ symbolizes an example of such a thrust exerted by a thermal actuator 42.

Figure 5:
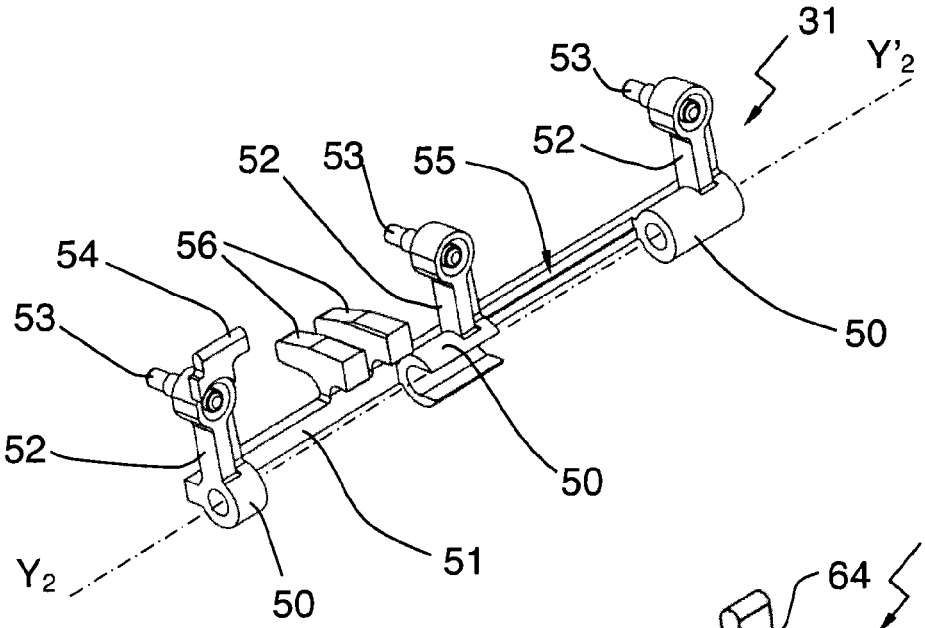
FIG. 5 is a perspective view of the first transmission bar visible in FIG. 4.

Transmission bar 31 is represented alone in FIG. 5. It comprises three mounting bearings 50 which are fitted on support shaft 33, offset from one another along pivoting axis $Y_2$-$Y'_2$ and rigidly connected by an axial tie bar 51. Transmission bar 31 also comprises as many arms 52 receiving a thrust force $P_1$ as there are thermal actuators 40. Each mounting bearing 50 supports one of arms 52, each of which comprises an add-on push-rod 53 distant from pivoting axis $Y_2$-$Y'_2$.

Arms 52 are offset from one another along pivoting axis $Y_2$-$Y'_2$ so that each head 41 can exert a mechanical tripping command in the form of a thrust force $P_1$, on a push-rod 53, in order to make transmission bar 31 swivel in the direction $S_2$, in reaction to a current overload.

One of arms 52 is provided with an actuating finger 54 of indicating part 15 of indicator 11.

Tie bar 51 comprises a rim 55 which exerts a thrust force on ratchet 30 to drive the latter to its released position, as will be specified further on.

Transmission bar 31 can be slid along support shaft 33. Its axial position can be adjusted by means of adjustment means 7. For this purpose, transmission bar 31 comprises a fork 56 coupling the latter to these adjustment means 7.

Bearings 50, tie bar 51, arms 52, finger 54 and fork 56 form part of one and the same component, moulded from polymer, to which push-rods 53 are fixed.

Figure 6:
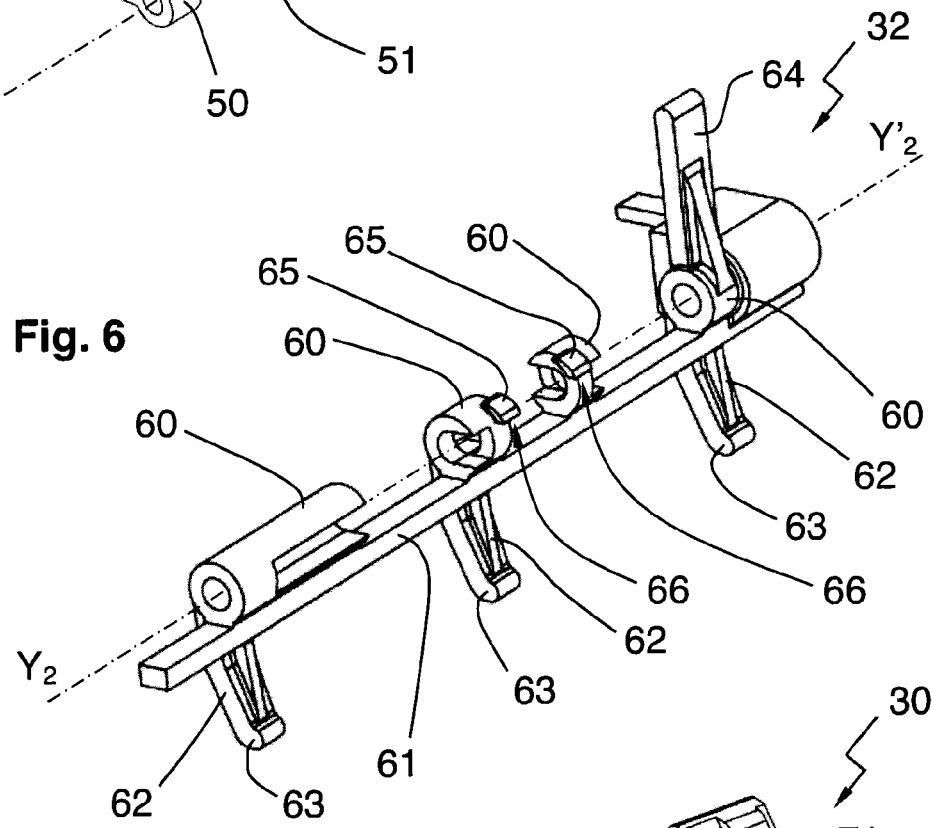
FIG. 6 is a perspective view of the second transmission bar visible in FIG. 4.

Transmission bar 32 is represented alone in FIG. 6. It comprises three mounting bearings 60 which are fitted on support shaft 33, offset from one another along pivoting axis $Y_2$-$Y'_2$ and rigidly connected by an axial tie bar 61. Transmission bar 32 also comprises as many arms 62 receiving a thrust force $P_2$ as there are magnetic actuators 42. Supported by one of hubs 60, each arm 62 comprises a push-rod 63 distant from pivoting axis $Y_2$-$Y'_2$.

Arms 62 are offset from one another along pivoting axis $Y_2$-$Y'_2$ so that each flap 41 can exert a mechanical tripping command in the form of a thrust force $P_2$, on a push-rod 63, in order to make transmission bar 32 swivel in the direction $S_2$, in reaction to a short-circuit.

A bearing 60 supports an actuating arm 64 of indicating part 15 of indicator 12.

Each of two successive bearings 60 supports a latching prong 65 which defines one of two flat surfaces 66 exerting a thrust force on ratchet 30 so as to drive the latter to its released position, as will be specified further on.

Transmission bar 32 is a monoblock part moulded from polymer.

Figure 7:
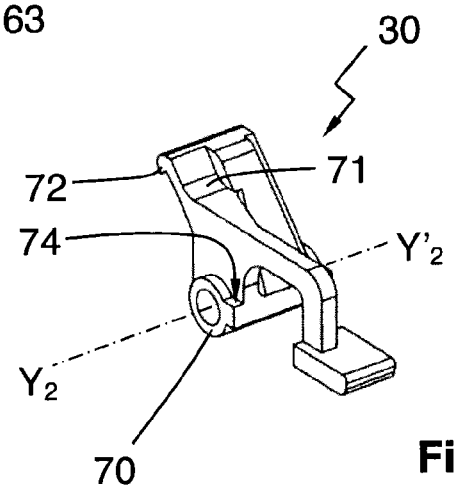
FIG. 7 is a perspective view of the ratchet visible in FIG. 4.
Figure 8:
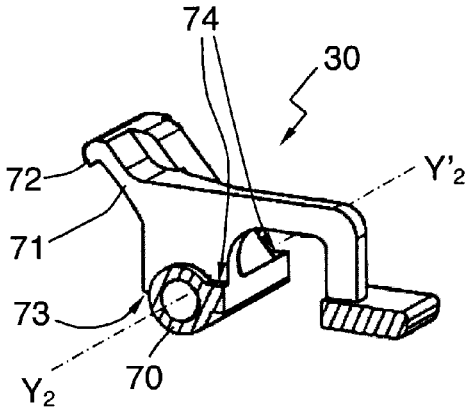
FIG. 8 is a perspective cross-sectional view representing the same ratchet as FIG. 7, from another angle.

Ratchet 30 is represented alone in FIGS. 7 and 8. It comprises a mounting hub 70 which is fitted on support shaft 33 and which bears a finger 71 securing striker 21 by latching. At a distance from hub 70, the free end of finger 71 is provided with a nose 72 for performing latching of striker 21.

Ratchet 30 defines a surface 73 extending outwards from hub 70, in substantially parallel manner to axis $Y_2$-$Y'_2$. This surface 73 is configured to collaborate with rim 55 and to receive a thrust from the latter. Ratchet 30 further defines two surfaces 74 extending outwards from hub 70, in substantially parallel manner to axis $Y_2$-$Y'_2$. These surfaces 74 are configured to collaborate with thrust surfaces 66 and at the same time to receive thrust forces from the latter.

Figure 9:
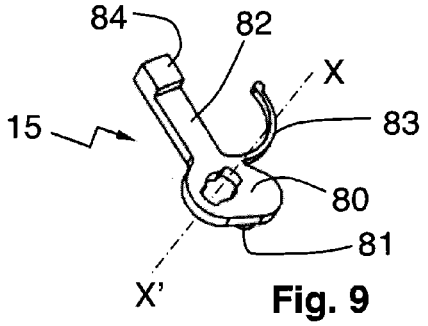
FIG. 9 is a perspective view of one of the two identical indicating parts which are constituent components of the trip device of FIG. 1 and serve the purpose of visual indication of which sort of cause is at the origin of the tripping commanded by this trip device.

An indicating part 15 is represented alone in FIG. 9. It comprises a crank arm 80, in which a fitting hole is drilled for a support shaft, not represented, centred on pivoting axis X-X'. Crank arm 80 is provided with a rear crankpin 81 offset with respect to pivoting axis X-X', a flexible finger 82 substantially perpendicular to this pivoting axis X-X', and a flexible arc 83 biasing indicating part 15 to a masked state. Finger 82 is elastically flexible to the rear, in a plane parallel to pivoting axis X-X'. Its free end bears a protuberance 84 that is able to engage in a window 14 thereby latching indicating part 15 in a visible state indicating that tripping has taken place.

Figure 10:
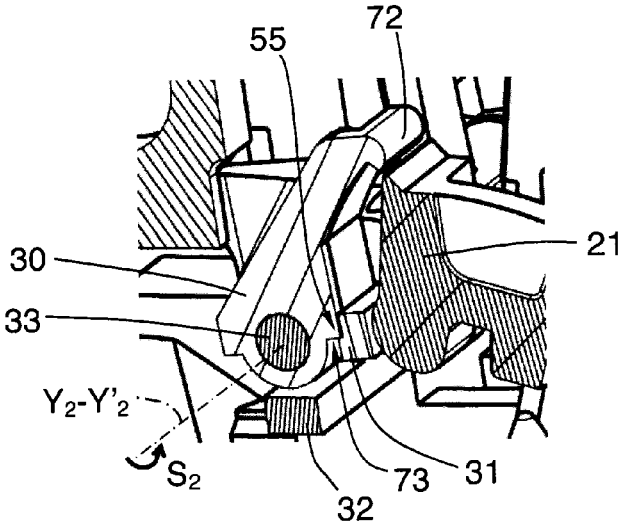
FIG. 10 is an enlargement of a window extracted from a cross-sectional view along a plane parallel to the plane III, with perspective, and illustrates actuation of the ratchet of FIG. 7 by the first transmission bar represented in FIG. 5, in case of a current overload.

When a current overload is flowing in conductor 3 of one of phases 2, thermal actuator 40 associated with this phase 3 produces a movement resulting in a thrust force $P_1$, making transmission bar 31 swivel in the direction $S_2$. This results in rim 55 latching on surface 73 and then pushing the latter in the direction $S_2$ thereby making ratchet 30 swivel to its released position, which is illustrated by FIG. 10. In this FIG. 10, striker 21 has unlatched from nose 72 and will start moving and then accelerate until it performs a percussion causing tripping of the circuit breaker.

Figure 11:
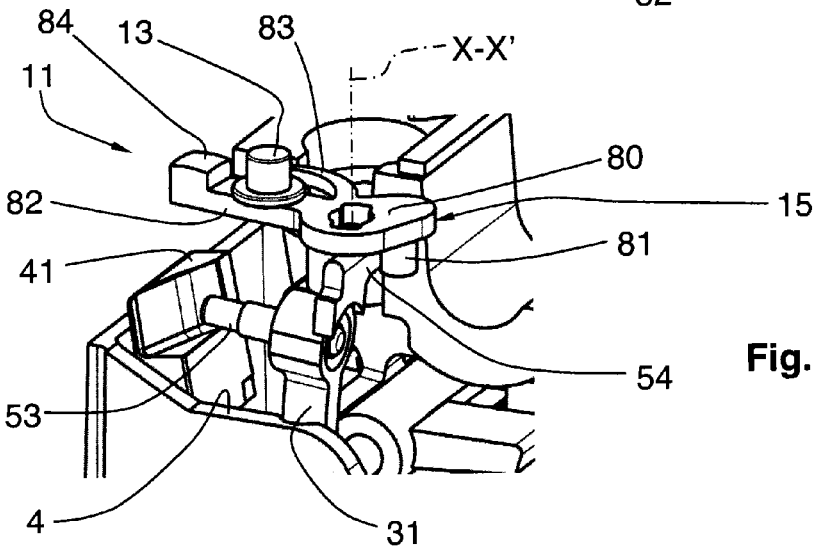
FIG. 11 is an enlargement of a window extracted from a perspective view and illustrates actuation of the indicating part of FIG. 9 by the first transmission bar represented in FIG. 5, in case of a current overload.

As illustrated in FIG. 11, swiveling of transmission bar 31 in the direction $S_2$ makes finger 54 push on crankpin 81 present in indicator 11 thereby actuating indicating part 15 of this indicator 11. Prior to the occurrence of a current overload, this indicating part 15 was in its masked state, which is the state represented in FIG. 12. In this FIG. 12, indicating part 15 of indicator 11 is kept in the same angular position as in FIG. 2 due to the flexible bias exerted by its flexible arc 83. It is then completely masked by front cover 5. Furthermore, finger 82 of indicator 11 is curved in flexible manner towards the rear.

When swiveling of transmission bar 31 takes place in the direction $S_2$, finger 54 makes indicating part 15 of indicator 11 swivel around the corresponding pivoting axis X-X', against the bias force exerted by arc 83 of this indicating part 15. After it has been actuated by finger 54, indicating part 15 of indicator 11 has changed state and is in its visible state, which is the one represented in FIGS. 13 and 14. In FIG. 13, finger 82 of indicator 11 has straightened on its own and it is henceforth rectilinear. Its protuberance 84 has engaged in window 14 of indicator 11, which latches indicating part 15 of indicator 11 in its visible state. The visible presence of protuberance 84 of indicator 11 in window 14 of this indicator 11 indicates that tripping consecutive to a current overload has taken place.

Once the cause of the current overload has been eliminated, a manual thrust on push-button 13 of indicator 11 makes this push-button bend finger 82 flexibly to the rear and push protuberance 84 out from window 14, in this indicator 11. When this protuberance 84 has moved out from the corresponding window 14, arc 83 of indicating part 15 of indicator 11 makes this indicating part 15 return to its masked state of FIGS. 2 and 12.

Figure 15:
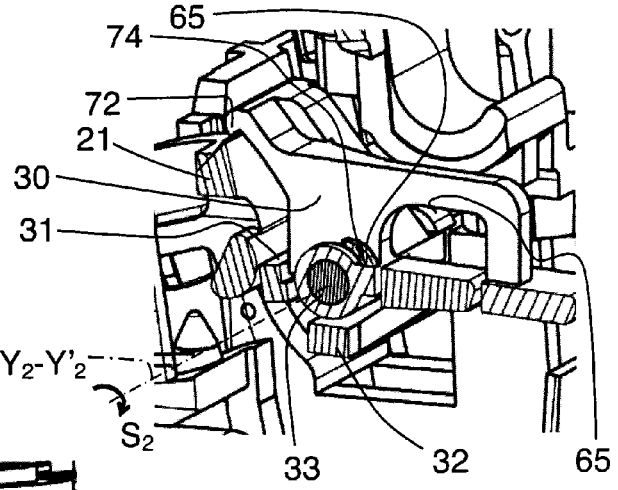
FIG. 15 is an enlargement of a window extracted from a cross-sectional view along a plane parallel to plane III, with perspective, and illustrates actuation of the ratchet of FIG. 7 by the second transmission bar represented in FIG. 6, in case of a short-circuit.

When a short-circuit current is flowing in conductor 3 of one of phases 2, magnetic actuator 42 associated with this phase 3 produces a movement resulting in a thrust force $P_2$, which a flap 43 applies on a push-rod 62. This thrust force $P_2$ makes transmission bar 32 swivel in the direction $S_2$. This results in prongs 65 pressing on surfaces 74, and then pushing together on the latter in the direction $S_2$ thereby making ratchet 30 swivel to its released position, which is illustrated by FIG. 15. In this FIG. 15, striker 21 has unlatched from nose 72 and will start moving and then accelerate until it performs a percussion causing tripping of the circuit breaker.

Figure 16:
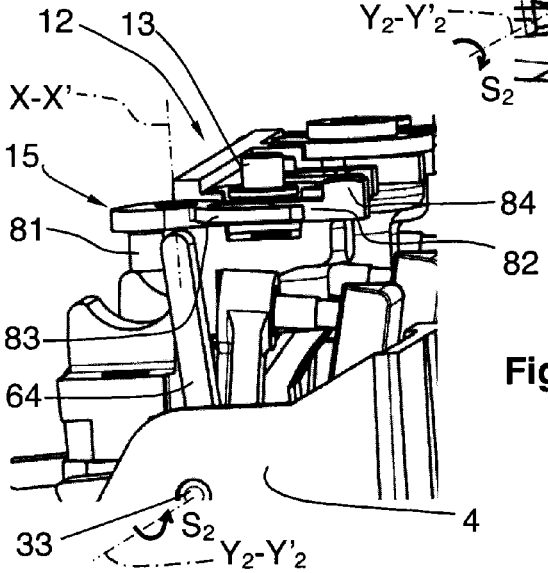
FIG. 16 is an enlargement of window extracted from a perspective view and illustrates actuation of the indicating parts identical to those of FIG. 7 by the second transmission bar represented in FIG. 6, in case of a short-circuit.
Figure 17:
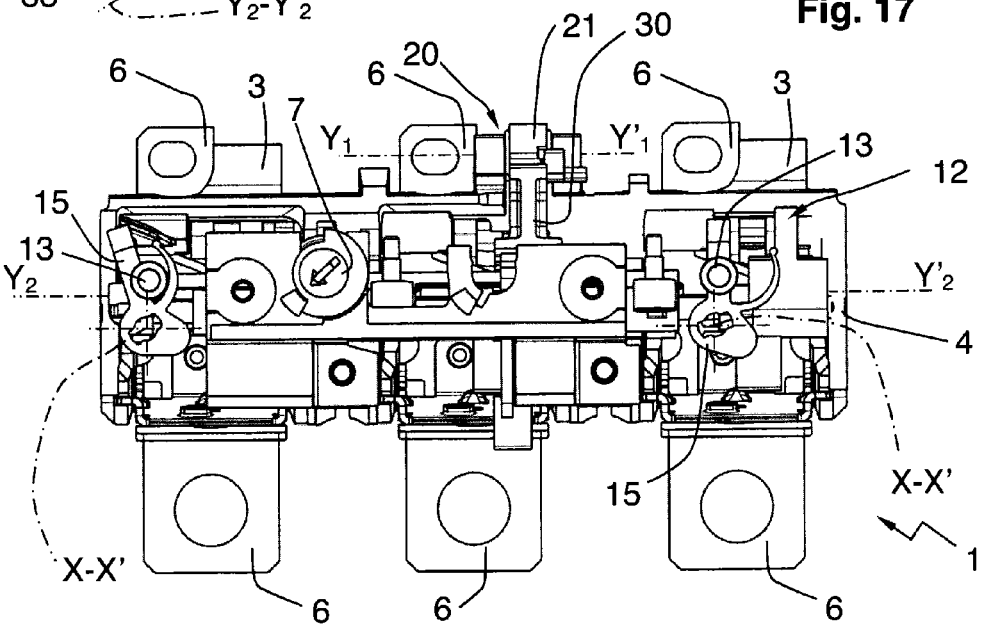
FIG. 17 is a front view of the trip device of FIG. 1 without its front cover and shows which are the respective positions of the two indicating parts after a tripping command generated by the trip device due to a short-circuit.

As illustrated in FIG. 16, swiveling of transmission bar 32 in the direction $S_2$ makes arm 64 push on crankpin 81 of indicating part 15, in indicator 12, thereby actuating this indicating part 15. Prior to the occurrence of a short-circuit, indicating part 15 of indicator 12 was in its masked state, which is the one represented in FIG. 2. After it has been made to swivel by finger 64, this indicating part 15 has changed state and is in its visible state, which is the state of FIG. 17 and which is the same as the state represented in FIG. 13. The visible presence of protuberance 84 of indicator 12 in window 14 of the same indicator 12 indicates that tripping consecutive to a short-circuit has taken place.

Once the cause of the short-circuit has been eliminated, a manual thrust on push-button 13 of indicator 12 makes the corresponding indicating part 15 return to its masked state of FIG. 2.

The invention is not limited to the embodiment described in the foregoing. In particular, transmission bar 32 is configured to form part of a thermal-magnetic trip device of high rating. Modifications can be made to this bar to adapt it to a thermal-magnetic trip device of low rating. These modifications can in particular involve the forming of arms 62 and their angular position around the axis $Y_2$-$Y'_2$.

The invention claimed is:

1. A thermal-magnetic trip device for monitoring several phase currents flowing in a multiphase circuit breaker and for tripping this multiphase circuit breaker in case of an anomaly affecting at least one of the phase currents, comprising:

several phases, several thermal actuators each of which is designed to react to a current overload in one of the phases by generating a mechanical tripping command, several magnetic actuators each of which is designed to react to a short-circuit in one of the phases by generating a mechanical tripping command, an intermediate transmission device configured to be able to receive any one of the mechanical tripping commands and comprising a ratchet flexibly biased in a first direction to a latched position, and arranged in such a way that receipt of a tripping command by the transmission device makes this ratchet move from its latched position, in which the ratchet can secure a tripping part in a neutral state by latching, to a released position in which the tripping part is disengaged from the ratchet, a support shaft on which the ratchet is fitted so as to be able to swivel around a pivoting axis between its latched and released positions, a first indicator designed to indicate tripping caused by a current overload, and a second indicator designed to indicate tripping caused by a short-circuit, a first transmission bar fitted on said support shaft so as to be able to be pivoted around the same pivoting axis as the ratchet, in a second direction opposite to the first direction, by any one of the thermal actuators, with a movement in the course of which this first transmission bar both drives the ratchet from its latched position to its released position and makes the first indicator change state, and a second transmission bar fitted on said support shaft so as to be able to be pivoted around the same pivoting axis as the ratchet, in the second direction, by any one of the magnetic actuators, with a movement in the course of which this second transmission bar both drives the ratchet from its latched position to its released position and makes the second indicator change state, the first and second transmission bars being disconnected from one another in pivoting around the pivoting axis.

2. The thermal-magnetic trip device according to claim 1, comprising:

a first flexible member biasing the first transmission bar to a rest position, in the first direction around the pivoting axis, a second flexible member biasing the second transmission bar to a rest position, in the first direction around the pivoting axis, a third flexible member biasing the ratchet away from its released position to its latched position, in the first direction around the pivoting axis.

3. The thermal-magnetic trip device according to claim 1, wherein the first transmission bar comprises several first bearings fitted on the support shaft, and at least a first tie bar rigidly associating the first bearings to one another, the second transmission bar comprising several second bearings fitted on the support shaft, and at least a second tie bar rigidly associating the second bearings to one another, the first and second bearings being offset from one another along said pivoting axis.

4. The thermal-magnetic trip device according to claim 1, wherein the first transmission bar comprises first arms arranged in such a way that, by acting on one of these arms, each thermal actuator can make the first transmission bar swivel in the second direction.

5. The thermal-magnetic trip device according to claim 1, wherein the second transmission bar comprises second arms arranged in such a way that, by acting on one of these arms, each magnetic actuator can make the second transmission bar swivel in the second direction.

6. The thermal-magnetic trip device according to claim 3, wherein each of the arms is supported by one of the first and second bearings.

7. The thermal-magnetic trip device according to claim 1, wherein at least one of the first and second indicators comprises:

a window arranged through an enclosure of the thermal-magnetic trip device, and an indicating part movable between a first state in which there is no portion of this indicating part located at the level of the window, and a second state in which the indicating part is at least partially visible from the outside through the window.

8. The thermal-magnetic trip device according to claim 7, wherein the indicating part is flexibly biased to the first state and comprises an elastically flexible finger bearing a protuberance that is able to latch the indicating part in its second state, by engaging in the window.

* * * * *